US005476386A

United States Patent [19]

Booth

[11] Patent Number: 5,476,386

[45] Date of Patent: Dec. 19, 1995

[54] BASE STRUCTURE FOR AN ELECTRICAL RELAY

[76] Inventor: David R. Booth, 8 Lake Court Dr., Pine Haven, Wyo. 82721

[21] Appl. No.: 74,553

[22] Filed: Jun. 11, 1993

[51] Int. Cl.[6] ..... H01R 13/60

[52] U.S. Cl. ..... 439/40

[58] Field of Search ..... 439/38, 39, 40, 439/41, 607, 609, 610; 335/202, 278, 285

[56] References Cited

U.S. PATENT DOCUMENTS

| | | | |
|---|---|---|---|
| 1,603,171 | 10/1926 | Wade | 439/40 |
| 1,641,880 | 9/1927 | Cohen | 439/40 X |
| 2,298,313 | 10/1942 | Ross | 439/38 X |
| 2,312,083 | 2/1943 | Doane | 439/39 |
| 2,709,245 | 5/1955 | Schneider | 439/40 |
| 2,855,578 | 10/1958 | Hirsch | 439/38 |

*Primary Examiner*—Khiem Nguyen
*Attorney, Agent, or Firm*—Risto A. Rinne, Jr.; Douglas M. Clarkson

[57] ABSTRACT

A base structure for receiving an electrical relay is described as being adapted to receive the relay removeably. Electrical contacts in the base connect the base electrically with the circuitry of the attached relay. Terminals are provided for the connection of external wiring to the base and are each connected to at least one of the electrical contacts. Permanent magnets affixed to the base attach the base securely to an electrical panel so that the base is easily removed. According to a modification, electro-magnetism is used to secure the base to the panel. A magnetic shield is disposed, according to a modification, between the source of magnetism and the attached relay.

20 Claims, 1 Drawing Sheet

BASE STRUCTURE FOR AN ELECTRICAL RELAY

BACKGROUND OF THE INVENTION

1. Field of the Invention

The present invention, in general, relates to apparatus used to secure an electrical relay in position and, more particularly, to a device that secures an electrical relay to a panel.

Relays are well known components for use with electrical and electronic applications. Relays themselves are often electro-magnetic types of devices although certain newer "solid state" types of relays do not rely upon an electro-magnetic coil to cause mechanical movement of contacts within the device. However all relays are used to control the flow of electricity in accordance with the level of a control signal that is supplied to the relay.

Certain applications require the temporary use of relays. An example of such an application is found in oil fields where relays are installed, used for a period of time, and then removed and used elsewhere. In such kinds of applications, the relays are physically mounted to a metal panel, often in an enclosure, which may house a plurality of such relays.

Relays are attached to a receptacle base normally by the insertion of the protruding contacts of the relay into a cooperating receptacle socket of the base. The relay base normally is attached to a panel by screws inserted through holes that must be drilled in the panel.

The drilling of such holes and the securing of the relay base by screws to the panel is a time consuming process. Similarly, the removal of the relay, including the relay base, from the panel is a time consuming process as well. Accordingly, there exists today a need for a device to secure a relay to a panel that can be readily affixed in position and, when desired, can be removed readily for use elsewhere.

While for the example provided, three phase, 440 volt relays are often used for oil field types of applications, the need, in general, for a relay base that is easy to install and to remove is applicable for many situations that utilize relays having various numbers of contacts (poles), single or double throw contacts, various operating and switching voltages and electrical phases.

2. Description of Prior Art

Relays are of themselves well known. The use of magnetism to secure a contact in cooperation with another contact is known. For example, the following patents describe various types of magnetic securing contact devices:

U.S. Pat. No. 2,573,920 to McLeod, Nov. 6, 1951;

U.S. Pat. No. 3,521,216 to Tolegian, Jul. 21, 1970;

U.S. Pat. No. 3,786,391 to Mathauser, Jan. 15, 1974;

U.S. Pat. No. 3,808,577 to Mathauser, Apr. 30, 1974;

U.S. Pat. No. 3,810,258 to Mathauser, May 7, 1974;

U.S. Pat. No. 3,868,160 to Kersman, Feb. 25, 1975;

U.S. Pat. No. 4,025,964 to Owens, May 31, 1977;

U.S. Pat. No. 4,112,941 to Larimore, Sept. 12, 1978;

U.S. Pat. No. 4,211,456 to Sears, Jul. 8, 1980;

U.S. Pat. No. 4,317,969 to Riegler et al, Mar. 2, 1982;

U.S. Pat. No. 4,451,113 to Zuniga, May 29, 1984; and

U.S. Pat. No. 4,647,120 to Karabakakis, Mar. 3, 1987.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an important object of the present invention to provide a relay construction that admits of securing in position more easily.

It is also an important object of the present invention to provide a relay structure that permits its base to be more readily attached to a surface having ferrous qualities.

It is also an object of the invention to provide a structure for a relay that permits its base to be readily detachable.

Another object of the invention is to provide a magnetic relay base that is adaptable to receive various relay device configurations.

Still another object of the invention is to provide a magnetic relay base that is non-destructive of the relay to permit a subsequent use of the same relay elsewhere as desired.

Briefly, an electrical relay base that is constructed in accordance with the principles of the present invention is adapted for receiving a relay and includes electrically conductive contacts affixed to the base to provide electrical continuity to a relay that is supported by the relay base. The relay base has a predetermined quantity of electrical contacts positioned in predetermined spaced apart intervals for electrically cooperating with the corresponding electrical contacts of a relay. Terminals on the relay base connect external wires to the base. The relay base is attached to a ferrous panel surface by magnetic means so that a relay is supported in a functional position with the base contacts.

The above and other features, objects and advantages of the invention will become more readily apparent from the following detailed description of the presently preferred embodiment, which is described in conjunction with accompanying drawings.

DETAILED DESCRIPTION OF THE INVENTION

Figure 1:
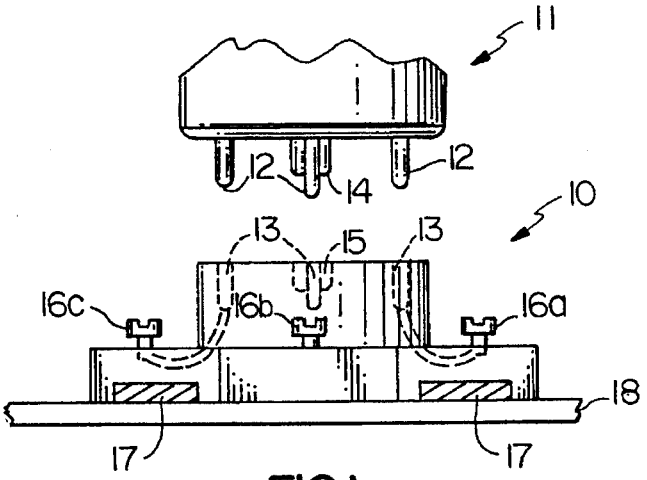
FIG. 1 is a side view of a relay base that is constructed in accordance with the present invention.
Figure 2:
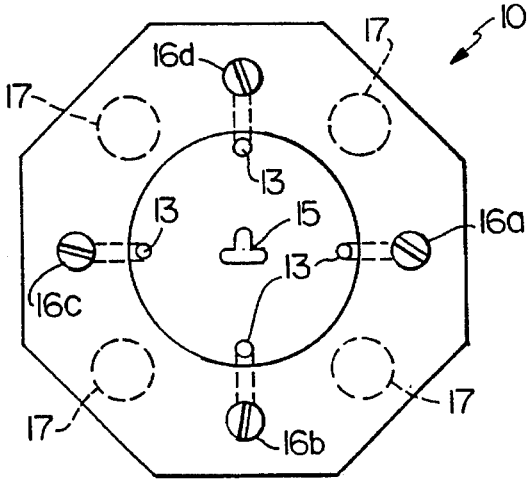
FIG. 2 is a top view of the relay base of FIG. 1.

In FIG. 1 and in FIG. 2 there is shown a relay base 10 according to the invention. A portion of a relay 11 is shown suspended over the base 10 for insertion of pins 12 in sockets 13.

The relay 11, typically, has male contact pins 12 at spaced apart locations which align with female receptacle sockets 13 in the base 10. A keyway 14 is provided on most types of relays to ensure proper alignment with a keyway receptacle 15 in the base 10. The keyway 14 and keyway receptacle 15 provide one structural arrangement by which the relay 11 is aligned in the base 10.

Certain types of special relays (not shown) ensure proper alignment between the special relay and special bases (not shown) by the distinct spacing and configuration of the contact pins or by the unique shape of the relay cooperating with the unique shape of the special base, and as such do not require the use of any keyway 14.

Some specialized types of relays have female type connectors. A modified relay base having corresponding male pins accommodate this type of relay. Similarly, the relay base 10 can be modified as may be necessary to accommodate the various types of relays for which it can be used.

For clarity of understanding, only 4 contact pins 12 are shown in the drawing illustrations. Most applications will require more contact pins 12. For example, the relay base 10, when it is used in oil field applications, will typically support either an eight or an eleven pin, 440 volt, three phase type of relay.

Screw terminals 16*a*, 16*b*, 16*c*, 16*d* are provided in the base 10 for connecting external wiring. Each of these screw terminals is electrically connected by an electrical conductor embedded in the base (shown in dashes FIG. 2) to one of the corresponding female receptacle sockets 13 of the base 10.

A modification would be to substitute for the exposed screw terminals 16*a*, 16*b*, 16*c*, 16*d* other means for connecting external wires to the base. One such modification would be to provide a contact screw terminal recessed within an opening in the base 10.

A wire to be connected would be inserted into a recess opening. Access must be provided for a recessed type of "screw" terminal to fasten such a wire. Recessed types of terminals are useful for preventing accidental contact from occurring with the wires.

Alternatively, certain types of recessed terminals retain the wire automatically that is inserted in the recess opening while also providing for an electrical connection. An example of a recessed terminal that automatically secures the wire inserted therein is in duplex outlet receptacles such as are used for residential electrical wiring where the wire to be connected first has a portion of its insulation stripped from the end of the wire.

The exposed conductor then is inserted into a recess opening in the back of the duplex receptacle and is retained automatically by a spring loaded fastener, while electrical contact is simultaneously being made. A screwdriver is used to overcome the force of the fastener for removal of the wire.

The material used to construct the relay base 10 is varied as desired. Plastic or similar types of electrically insulating materials are preferred. The base 10 may be constructed of an electrically conductive material, such as of a cast metal, like aluminum, providing that the screw terminals 16*a*, 16*b*, 16*c*, 16*d*; sockets 13; and connecting wires are electrically insulated apart from the electrically conductive material.

Embedded in the base 10 are one or more permanent magnets 17 that are affixed to the base 10. The magnets 17 are located as close as possible to the bottom surface of the base 10 to provide the maximum amount of magnetic attraction to a ferrous surface 18. The base 10 is secured to the surface 18 by magnetic flux produced by the magnetic field generated by the magnets 17.

The quantity, location, size, and quality of the magnets 17 are varied as desired to secure any given relay to any desired ferrous surface 18. For example, if the relay base 10 is to be secured to a surface that is expected to experience strong vibration, a quantity of stronger magnets 17 are affixed to the base 10. If the application requires only that the base 10 be held lightly in position as few as only one magnet 17 is used.

The magnets 17, as shown, are spaced apart radially around the base 10. The position and shape of the magnets 17 are each variable and are selected to satisfy the adhesion requirements and consumer preference. For example, a circuitous magnet may be placed entirely around the base, if desired. Or, if the base 10 is to be secured to an uneven ferrous surface, a majority of the magnets 17 to be used are affixed in a corresponding area of the base to better cooperate with the uneven surface.

The use of magnets 17 to secure the relay base 10 to a ferrous surface 18 obviates the need to drill holes into the surface 18. Similarly tapping of the holes is not needed nor are self tapping or machine screws required to secure the base 10 to the surface 18. The use of magnets 17 provides a way to readily affix the base 10 to a ferrous surface 18 simply by applying it directly to the surface. Magnetism is used to retain the base 10 in position.

The use of permanent type of magnets 17 ensures that the base will remain affixed to the surface 18 for as long as is desired. For certain types of applications, the base 10 is affixed temporarily, such as to provide emergency services while performing repairs. For other types of more permanent applications the base 10 is affixed to the surface 18 for a duration as long as is the life of the application itself.

The surface 18 must be of at least partially ferrous material for the magnets 17 to adhere to. Typically, the surface 18 is an electrical panel which may have other kinds of circuitry affixed to it as well. The electrical panel may be an exposed planar surface but is more typically a recessed surface situated within an electrical enclosure box. Such kinds of enclosures are referred to as either electrical panel boxes or as electrical power distribution panels.

The base 10, when desired, is removed from the surface 18 by pulling it away from the surface 18 by applying a force sufficient to overcome the magnetic attractive forces. If preferred, a pull handle can be attached to the base 10 to aid in its removal from the surface 18. Another advantage provide by the magnetic relay base 10 is that after it has been removed from the surface 18, the surface 18 is left unmarred. Furthermore, the base 10 and relay 11 are not damage or consumed during usage. Therefore, once the base 10 and the relay 11 have been removed from a particular surface 18, they are available for repeated use as desired on another ferrous surface.

To avoid reducing the available magnetic flux, ferrous material is not preferred for construction of the base 10. If special circumstances require the use of a considerable amount of ferrous material to construct some portion of the base 10, the ferrous materials must be situated within the base 10 a suitable distance away from the magnets 17. This is necessary to prevent a significant loss of magnetic flux which would occur if an alternative magnetic flux path were provided that caused the flux to pass between the ferrous portions of the base 10 and the magnets 17 rather than between the magnets 17 and the ferrous surface 18.

Figure 3:
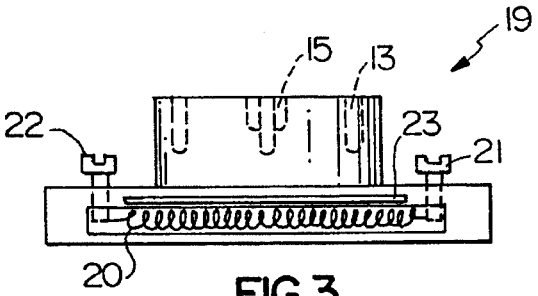
FIG. 3 is a view in elevation, partly in cross section, of a modified form of relay base according to the principles of the present invention.

Referring to FIG. 3, there is shown a modified relay base 19. The modified relay base 19 uses an electro-magnet 20 to create the necessary magnetism. A single electro-magnet 20 is shown affixed to the modified base 19. However, a plurality of electro-magnets 20 are used when required to provide an increased amount of magnetic attraction (flux).

Each end of the electro-magnet 20 is attached to electrical power contact terminals 21 and 22. In order to cause the modified relay base 19 to generate the required magnetic attraction a source of electrical power, either alternating or direct current, is supplied across the power contact terminals 21 and 22 of the electro-magnet 20. This energizes the electro-magnet 20 and produces the necessary magnetic flux to cause the modified relay base 19 to adhere to a ferric surface.

A shield plate 23 is embedded in the modified relay base 19 and is situated between the electro-magnet 20 and the relay. The shield plate 23 is not required for all applications but is preferred whenever the magnetic force necessary to adhere the modified base 19 to the surface is sufficiently intense to cause possible interference with the proper operation of either the attached relay or with other electrical components that are proximally located.

The shield plate 23 is constructed of at least a partially ferric material. As such, an alternative magnetic flux path is provided for a portion of the magnetic field that is directed through the shield plate 23. The flux passing through the shield plate 23 decreases the magnetic field strength which the relay and surrounding components would otherwise experience. Of course, the shield plate 23 must be selected not to excessively diminish the magnetic flux available for adhering the modified base 19 to the surface.

While the use of the shield plate 23 is described for use in cooperation with an electro-magnet 20, the use of a shield plate affixed to a relay base 10 that uses permanent magnets 17 is equally applicable for the same reasons as have been described hereinabove.

The invention has been shown, described and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A base structure for receiving an electrical relay and for supporting the relay removably, comprising:

a base adapted for receiving said electrical relay and for supporting said relay removably;

contact means affixed to said base for connecting said relay electrically to circuit components external of said relay;

means for defining a wire connection means affixed to said base;

electrical continuity means between said means for defining a wire connection means and said contact means, and magnetic means affixed to said base, whereby said magnetic means is capable of securing said base by magnetism to a ferrous surface.

2. The base structure of claim 1 wherein said base includes alignment means between said relay and said base.

3. The base structure of claim 2 wherein said alignment means includes keyway means.

4. The base structure of claim 1 wherein said contact means includes a predetermined quantity of electrical contacts positioned at a predetermined spaced apart relationship for electrically cooperating with the corresponding electrical contacts of a relay.

5. The base structure of claim 4 wherein said contact means includes receptacle means.

6. The base structure of claim 5 wherein said receptacle means includes female socket means.

7. The base structure of claim 1 wherein said contact means includes male pin means.

8. The base structure of claim 1 wherein said means for defining a wire connection means includes terminal means.

9. The base structure of claim 8 wherein said terminal means includes screw terminal means.

10. The base structure of claim 8 wherein said terminal means includes recessed terminal means.

11. The base structure of claim 8 wherein said terminal means includes spring terminal means.

12. The base structure of claim 1 wherein said electrical continuity means includes conductive means.

13. The base structure of claim 12 wherein said conductive means includes wire means.

14. The base structure of claim 1 wherein said magnetic means includes permanent magnet means.

15. The base structure of claim 14 wherein said permanent magnet means includes a plurality of permanent magnet means.

16. The base structure of claim 1 wherein said magnetic means includes electro-magnetic means.

17. The base structure of claim 16 wherein said electro-magnetic means includes a plurality of electro-magnetic means.

18. The magnetic relay base of claim 16 wherein said electro-magnetic means includes electro-magnet terminal means for connecting a source of electrical power useful to energize said electro-magnetic means.

19. The base structure of claim 1 wherein said base in includes magnetic shield means.

20. The base structure of claim 19 wherein said magnetic shield means includes a ferric plate means disposed between said magnetic means and said relay.

* * * * *